US006936581B2

(12) United States Patent
Eskuchen et al.

(10) Patent No.: US 6,936,581 B2
(45) Date of Patent: Aug. 30, 2005

(54) PROCESSES FOR PREPARING ANHYDROUS DETERGENT GRANULES

(75) Inventors: Rainer Eskuchen, Langenfeld (DE); Manfred Weuthen, Langenfeld (DE); Ditmar Kischkel, Monheim (DE); Tycho Michel, Langenfeld (DE); Bernhard Gutsche, Hilden (DE)

(73) Assignee: Cognis Deutschland GmbH & Co. KG, Duesseldorf (DE)

( * ) Notice: Subject to any disclaimer, the term of this patent is extended or adjusted under 35 U.S.C. 154(b) by 227 days.

(21) Appl. No.: 10/258,369

(22) PCT Filed: Apr. 10, 2001

(86) PCT No.: PCT/EP01/04084

§ 371 (c)(1),
(2), (4) Date: Oct. 21, 2002

(87) PCT Pub. No.: WO01/81529

PCT Pub. Date: Nov. 1, 2001

(65) Prior Publication Data

US 2003/0039624 A1 Feb. 27, 2003

(30) Foreign Application Priority Data

Apr. 19, 2000 (DE) ..... 100 19 405

(51) Int. Cl.[7] ..... C11D 3/22; C11D 11/02; C11D 13/00; C11D 17/06

(52) U.S. Cl. ..... 510/446; 510/353; 510/443; 510/444; 510/452; 510/470; 510/535

(58) Field of Search ..... 510/353, 443, 510/444, 446, 452, 470, 535

(56) References Cited

U.S. PATENT DOCUMENTS

| | | | | |
|---|---|---|---|---|
| 3,966,629 A | | 6/1976 | Dumbrell | |
| 4,062,647 A | | 12/1977 | Storm et al. | |
| 4,524,009 A | | 6/1985 | Valenty | |
| 4,639,325 A | | 1/1987 | Valenty et al. | |
| 4,664,839 A | | 5/1987 | Rieck | |
| 4,737,306 A | | 4/1988 | Wichelhaus et al. | |
| 4,816,553 A | | 3/1989 | Baur et al. | |
| 4,985,553 A | | 1/1991 | Fuertes et al. | |
| 5,002,695 A | | 3/1991 | Schulz et al. | |
| 5,356,607 A | | 10/1994 | Just | |
| 5,374,716 A | | 12/1994 | Bierman et al. | |
| 5,494,488 A | | 2/1996 | Arnoldi et al. | |
| 5,501,814 A | | 3/1996 | Engelskirchen et al. | |
| 5,541,316 A | | 7/1996 | Engelskirchen et al. | |
| 5,576,425 A | | 11/1996 | Hill et al. | |
| 5,580,941 A | | 12/1996 | Krause et al. | |
| 5,780,420 A | | 7/1998 | Breuer et al. | |
| 5,821,360 A | | 10/1998 | Engelskirchen et al. | |
| 5,830,956 A | | 11/1998 | Stockhausen et al. | |
| 5,866,530 A | | 2/1999 | Schmid et al. | |
| 5,959,101 A | | 9/1999 | Engelskirchen et al. | |
| 6,030,937 A | * | 2/2000 | Kruse et al. | 510/443 |
| 6,075,001 A | | 6/2000 | Wilde | |
| 6,153,576 A | | 11/2000 | Blum et al. | |
| 6,187,055 B1 | | 2/2001 | Kottwitz et al. | |
| 6,200,946 B1 | | 3/2001 | Blum et al. | |
| 6,506,720 B1 | | 1/2003 | Blasey et al. | |

FOREIGN PATENT DOCUMENTS

| | | |
|---|---|---|
| DE | 2 334 899 A | 1/1974 |
| DE | 25 53 900 A1 | 6/1977 |
| DE | 35 26 405 A1 | 2/1987 |
| DE | 42 21 381 C1 | 2/1994 |
| DE | 43 00 772 A1 | 7/1994 |
| DE | 43 03 320 A1 | 8/1994 |
| DE | 43 25 308 A1 | 2/1995 |
| DE | 44 00 024 A1 | 7/1995 |
| DE | 44 16 438 A1 | 11/1995 |
| DE | 44 17 734 A1 | 11/1995 |
| DE | 44 43 177 A1 | 6/1996 |
| DE | 195 29 905 A1 | 2/1997 |
| DE | 195 36 082 A1 | 4/1997 |
| DE | 196 00 018 A1 | 7/1997 |
| DE | 196 05 688 A1 | 8/1997 |
| DE | 196 13 103 A1 | 10/1997 |
| DE | 196 20 411 A1 | 10/1997 |
| DE | 196 16 693 A1 | 11/1997 |
| DE | 196 16 767 A1 | 11/1997 |
| DE | 196 16 769 A1 | 11/1997 |
| DE | 196 16 770 A1 | 11/1997 |
| DE | 196 20 267 A1 | 11/1997 |
| DE | 197 09 991 C2 | 9/1998 |
| DE | 197 10 254 A1 | 9/1998 |
| EP | 0 026 529 B2 | 4/1981 |
| EP | 0 028 432 B2 | 5/1981 |

(Continued)

OTHER PUBLICATIONS

"Verdickungsmittel Für Alkylglucosidhaltige Tensidformulierungen" (Mar. 1997), Research Disclosure, Kenneth Mason Publications, Hampshire, GB, NR. 39549, Page(s) 189–190, XP000698580 ISSN: 0374–4353, not translated.

R.C. MacKenzie and B.D. Mitchell, "Differential Thermal Analysis, A Review", The Analyst, vol. 87, (Jun., 1962), pp. 420–434.

J. Pharm. Sci., vol. 61, (1972) (reciting entire book—not enclosed) no month given.

"Tablettensprengmittel", Römpp Chemilexikon, 9th Ed., vol. 6, (1972), p. 4440, not translated; no month given.

Voight, "Lehrbuch der pharmazeutischen Technologie", 6th Ed., (1987), pp. 182–184, not translated; no month given.

*Primary Examiner*—Brian P. Mruk
(74) *Attorney, Agent, or Firm*—Arthur G. Seifert

(57) ABSTRACT

Processes are described for preparing anhydrous detergent granules, wherein the processes comprise: (a) providing an alk(en)yl oligoglycoside composition having a residual fatty alcohol content; (b) reducing the fatty alcohol content of the composition to 30% by weight or less to provide a reduced alcohol content alk(en)yl oligoglycoside; and (c) combining the reduced alcohol content alk(en)yl oligoglycoside with one or more detergent additives.

19 Claims, No Drawings

FOREIGN PATENT DOCUMENTS

| | | | | | |
|---|---|---|---|---|---|
| EP | 0 150 930 | B1 | | 8/1985 | |
| EP | 0 164 514 | A1 | | 12/1985 | |
| EP | 0 232 202 | B1 | | 8/1987 | |
| EP | 0 272 030 | A2 | | 6/1988 | |
| EP | 0 280 223 | B1 | | 8/1988 | |
| EP | 0 301 298 | B1 | | 2/1989 | |
| EP | 0 309 931 | B1 | | 4/1989 | |
| EP | 0 392 592 | B1 | | 10/1990 | |
| EP | 0 427 349 | A1 | | 5/1991 | |
| EP | 0 443 651 | B1 | | 8/1991 | |
| EP | 0 446 982 | B1 | | 9/1991 | |
| EP | 0 453 003 | B1 | | 10/1991 | |
| EP | 0 458 397 | B1 | | 11/1991 | |
| EP | 0 458 398 | B1 | | 11/1991 | |
| EP | 0 472 042 | A1 | | 2/1992 | |
| EP | 0 496 510 | B1 | | 7/1992 | |
| EP | 0 525 239 | A1 | | 2/1993 | |
| EP | 0 542 496 | B1 | | 5/1993 | |
| EP | 0 544 490 | A1 | | 6/1993 | |
| EP | 0 544 519 | B1 | | 6/1993 | |
| EP | 0 549 271 | B1 | | 6/1993 | |
| EP | 0 549 272 | A1 | | 6/1993 | |
| EP | 0 693 550 | A2 | | 1/1996 | |
| EP | 0 703 292 | B1 | | 3/1996 | |
| GB | 1 400 898 | A | | 7/1975 | |
| GB | 94 19 091 | A1 | | 9/1994 | |
| JP | 93/339896 | A | | 12/1993 | |
| WO | WO 90/03977 | A1 | | 4/1990 | |
| WO | WO 91/08171 | A1 | | 6/1991 | |
| WO | WO 92/18542 | A1 | | 10/1992 | |
| WO | WO 93/08251 | A1 | | 4/1993 | |
| WO | WO 93/16110 | A1 | | 8/1993 | |
| WO | WO 93/22917 | A1 | | 11/1993 | |
| WO | WO 94/27970 | A1 | | 12/1994 | |
| WO | WO 94/28030 | A1 | | 12/1994 | |
| WO | WO 94/28102 | A1 | | 12/1994 | |
| WO | WO 94/28103 | A1 | | 12/1994 | |
| WO | WO 95/00626 | A1 | | 1/1995 | |
| WO | WO 95/07303 | A1 | | 3/1995 | |
| WO | WO 95/12619 | A1 | | 5/1995 | |
| WO | WO 95/14075 | A1 | | 5/1995 | |
| WO | WO 95/14759 | A | | 6/1995 | |
| WO | WO 95/17498 | A1 | | 6/1995 | |
| WO | WO 95/20029 | A1 | | 7/1995 | |
| WO | WO 95/20608 | A1 | | 8/1995 | |
| WO | WO 95/22595 | A1 | | 8/1995 | |
| WO | WO 95/27775 | A1 | | 10/1995 | |
| WO | WO 97/03165 | A1 | | 1/1997 | |
| WO | WO 97/10324 | A1 | | 3/1997 | |
| WO | WO 97/10324 | | * | 3/1997 | ..... C11D/11/00 |
| WO | WO 98/40460 | | * | 9/1998 | ..... C11D/11/00 |
| WO | WO 98/40462 | A1 | | 9/1998 | |
| WO | WO 98/40463 | A1 | | 9/1998 | |
| WO | WO 98/55583 | A1 | | 9/1998 | |
| WO | WO 98/55590 | A1 | | 12/1998 | |

* cited by examiner

PROCESSES FOR PREPARING ANHYDROUS DETERGENT GRANULES

BACKGROUND OF THE INVENTION

Alkyl oligoglucosides are important detergent surfactants since, being nonionic compounds, they are compatible with a large number of other ingredients, but exhibit foaming and cleaning ability which is much more akin to that of anionic surfactants. They are prepared starting from glucose and fatty alcohol, which are acetalized in the presence of acidic catalysts. To shift the reaction equilibrium, the fatty alcohol is generally used in considerable excess, which means that the resulting glucosides then have to be freed from unreacted alcohol at great technical expense, otherwise they then reach the commercial sector in the form of aqueous pastes. However, for the production of solid detergents, primarily of extrudates, heavy powders and more recently also for tablets, alkyl oligoglucosides are increasingly desired in solid supply forms.

The subject-matter of the international patent application WO 97/03165 (Henkel) is a method in which aqueous alkyl oligoglucoside pastes are dried in a fluidized bed. WO 97/10324 (Henkel) discloses a similar method in which the drying and simultaneous granulation is undertaken in a VRV dryer. The prior art thus starts from aqueous pastes, i.e. the relevant methods start from a point at which considerable expenditure has already been made to separate off the unreacted fatty alcohol; accordingly, the products in the production are very expensive.

The object of the present invention was accordingly to provide a method for the production of anhydrous detergent granules with a high content of alk(en)yl oligoglycosides which is free from the described disadvantages, i.e. links in at the earliest possible point in the production of the glycosides and thus minimizes the technical expenditure and the production costs for the granules.

BRIEF SUMMARY OF THE INVENTION

The present invention relates, in general, to solid detergents and relates to a novel method for the production of solid, anhydrous detergent granules based on sugar surfactants.

The invention provides a method for the production of anhydrous detergent granules in which technical-grade mixtures of alkyl and/or alkenyl oligoglycosides and fatty alcohols are reduced to a residual fatty alcohol content of at most 30% by weight, and the resulting melt is mixed with detergent additives in a mixer or extruder.

Surprisingly, it has been found that it is possible to obtain stable flowable and anhydrous granules with a high content of alkyl and/or alkenyl oligoglycosides for use in the detergents sector in a simple and cost-effective manner by freeing the technical-grade starting mixtures from the acetalation from fatty alcohol partially up to below a critical limit of 30% by weight, preferably to 5–25% by weight, and then mixing these intermediates in a simple way with detergent additives, such as, for example, builders or disintegrants. The amount of fatty alcohol present in the granules impairs neither the stability of the granules nor proves to be disadvantageous in the end formulations. It has even been observed that the fatty alcohol content has an advantageous effect on the flowability of the granules and their tendency to absorb water.

Alkyl and/or Alkenyl Oligoglycosides

Alkyl and alkenyl oligoglycosides are known nonionic surfactants which conform to the formula (I)

$$R^1O\text{-}[G]p \qquad (I)$$

in which $R^1$ is an alkyl and/or alkenyl radical having 4 to 22 carbon atoms, G is a sugar radical having 5 or 6 carbon atoms and p is numbers from 1 to 10. They can be obtained by the relevant methods of preparative organic chemistry. By way of representation for the extensive literature, reference may be made here to the specifications EP-A1 0301298 and WO 90/03977.

The alkyl and/or alkenyl oligoglycosides can be derived from aldoses and ketoses having 5 or 6 carbon atoms, preferably glucose. The preferred alkyl and/or alkenyl oligoglycosides are thus alkyl and/or alkenyl oligoglucosides. The index number p in the general formula (I) gives the degree of oligomerization (DP), i.e. the distribution of mono- and oligoglycosides, and is a number between 1 and 10. While p in a given compound must always be an integer and here primarily can assume the values p=1 to 6, the value p for a certain alkyl oligoglycoside is an analytically determined parameter which in most cases is a fraction. Preference is given to using alkyl and/or alkenyl oligoglycosides with an average degree of oligomerization p of from 1.1 to 3.0. From a performance viewpoint, preference is given to those alkyl and/or alkenyl oligoglycosides whose degree of oligomerization is less than 1.7 and in particular is between 1.2 and 1.4.

The alkyl or alkenyl radical $R^1$ can be derived from primary alcohols having 4 to 11, preferably 8 to 10, carbon atoms. Typical examples are butanol, caproic alcohol, caprylic alcohol, capric alcohol and undecyl alcohol, and technical-grade mixtures thereof, as are obtained, for example, during the hydrogenation of technical-grade fatty acid methyl esters or in the course of the hydrogenation of aldehydes from the Roelen oxo synthesis. Preference is given to alkyl oligoglucosides of chain length $C_8$–$C_{10}$ (DP=1 to 3), which are produced as forerunner in the distillative separation of technical-grade $C_8$–$C_{18}$-coconut fatty alcohol and may be contaminated with a content of less than 6% by weight of $C_{12}$-alcohol, and alkyl oligoglucosides based on technical-grade $C_{9/11}$-oxo alcohols (DP=1 to 3). The alkyl or alkenyl radical $R^1$ can also be derived from primary alcohols having 12 to 22, preferably 12 to 18, carbon atoms. Typical examples are lauryl alcohol, myristyl alcohol, cetyl alcohol, palmoleyl alcohol, stearyl alcohol, isostearyl alcohol, oleyl alcohol, elaidyl alcohol, petroselinyl alcohol, arachyl alcohol, gadoleyl alcohol, behenyl alcohol, erucyl alcohol, brassidyl alcohol, and technical-grade mixtures thereof, which can be obtained as described above. Preference is given to alkyl oligoglucosides based on hydrogenated $C_{12/14}$-coco alcohol with a DP of from 1 to 3.

Fatty Alcohols

Fatty alcohols are to be understood as meaning primary aliphatic alcohols of the formula (II)

$$R^2OH \qquad (II)$$

in which $R^2$ is an aliphatic, linear or branched hydrocarbon radical having 6 to 22 carbon atoms and 0 and/or 1, 2 or 3 double bonds. Typical examples are caproic alcohol, caprylic alcohol, 2-ethylhexyl alcohol, capric alcohol, lauryl alcohol, isotridecyl alcohol, myristyl alcohol, cetyl alcohol, palmoleyl alcohol, stearyl alcohol, isostearyl alcohol, oleyl alcohol, elaidyl alcohol, petroselinyl alcohol, linolyl alcohol, linolenyl alcohol, elaeostearyl alcohol, arachyl alcohol, gadoleyl alcohol, behenyl alcohol, erucyl alcohol and brassidyl alcohol, and technical-grade mixtures thereof, which are produced, for example, during the high-pressure hydrogenation of technical-grade methyl esters based on fats and oils or aldehydes from the Roelen oxo synthesis, and as monomer fraction during the dimerization of unsaturated fatty alcohols. Preference is given to technical-grade fatty alcohols having 12 to 18 carbon atoms, such as, for example, coconut, palm, palm kernel or tallow fatty alcohol.

Although it is of course possible to prepare corresponding preproducts by mixing alkyl oligoglucosides and fatty alcohols—in this case products with different alkyl radicals could be prepared—for the purposes of the method according to the invention it is of course preferred to use technical-grade synthetic mixtures, i.e. the two radicals $R^1$ in the glucoside and $R^2$ in the fatty alcohol are then identical. Usually, those technical-grade mixtures are used which comprise the alkyl and/or alkenyl oligoglycosides and the fatty alcohols in the weight ratio 50:50 to 10:90, preferably 40:60 to 20:80 and in particular 35:65 to 40:70.

Depletion

Since the fatty alcohol contributes nothing to the washing result, it is desirable, for economic reasons, to keep its content as low as possible. A very low fatty alcohol content, however, means a high input of energy for the evaporation, which would then be economically detrimental to the method, on the other hand. Furthermore, it must be taken into consideration that the glycosides are thermally sensitive, i.e. a gentle and thus technically complex separation would be required. Conversely, a relatively high content of fatty alcohol offers a certain economic advantage since the separation can be carried out with lower expenditure. However, this parameter is again limited by the fact that most detergent formulations do not tolerate surfactant granules with a fatty alcohol content above 30% by weight; higher alcohol contents additionally destabilize the granules. For this reason, the depletion of the fatty alcohol from the technical-grade mixtures always represents a compromise between said parameters.

The actual depletion is less critical from a technical viewpoint, i.e. taking into consideration the known low thermal stability of sugar surfactants (risk of caramelization), all evaporator types are suitable which take into account this circumstance, but preferably thin-film evaporators, falling-film evaporators or short-path evaporators, and—if necessary—any combinations of these components. The depletion can then be carried out in a manner known per se, for example at temperatures in the range from 110 to 160° C. and reduced pressures of from 0.1 to 10 mbar.

Detergent Additives

To prepare the detergent granules, the depleted glycoside-fatty alcohol mixtures are, directly after leaving the evaporator, i.e. still in the molten state, admixed with typical detergent additives, which may, for example, be builders, cobuilders, oil- and grease-dissolving substances, bleaches, bleach activators, enzymes, enzyme stabilizers, antiredeposition agents, optical brighteners, polymers, defoamers, disintegrants, fragrances and/or inorganic salts.

Builders

The finely crystalline, synthetic and bonded-water-containing zeolite frequently used as laundry detergent builder is preferably zeolite A and/or P. As zeolite P, particular preference is given, for example, to zeolite MAP® (commercial product from Crosfield). Also suitable, however, are zeolite X and mixtures of A, X and/or P, and also Y. Of particular interest is also a co-crystallized sodium/potassium-aluminum silicate of zeolite A and zeolite X, which is available commercially as VEGOBOND AX® (commercial product from Condea Augusta S.p.A.). The zeolite can be used as a spray-dried powder or else as an undried stabilized suspension still moist from its preparation. In cases where the zeolite is used as suspension, the latter can comprise small additions of nonionic surfactants as stabilizers, for example 1 to 3% by weight, based on zeolite, of ethoxylated $C_{12}$–$C_{18}$-fatty alcohols having 2 to 5 ethylene oxide groups, $C_{12}$–$C_{14}$-fatty alcohols having 4 to 5 ethylene oxide groups or ethoxylated isotridecanols. Suitable zeolites have an average particle size of less than 10 $\mu$m (volume distribution; measurement method: Coulter counter) and preferably comprise 18 to 22% by weight, in particular 20 to 22% by weight, of bonded water.

Suitable substitutes or partial substitutes for phosphates and zeolites are crystalline, layered sodium silicates of the general formula $NaMSi_xO_{2x+1}.yH_2O$, where M is sodium or hydrogen, x is a number from 1.9 to 4 and y is a number from 0 to 20, and preferred values for x are 2, 3, or 4. Such crystalline phyllosilicates are described, for example, in European patent application EP 0164514 A1. Preferred crystalline phyllosilicates of the given formula are those in which M is sodium and x assumes the values 2 or 3. Particular preference is given to both β- and also δ-sodium disilicates $Na_2Si_2O_5.yH_2O$, where β-sodium disilicate can be obtained, for example, by the process described in international patent application WO 91/08171. Further suitable phyllosilicates are known, for example, from the patent applications DE 2334899 A1, EP 0026529 A1 and DE 3526405 A1. Their usability is not limited to a specific composition or structural formula. However, preference is given here to smectites, in particular bentonites. Suitable phyllosilicates which belong to the group of water-swellable smectites are, for example, those of the general formulae

| | |
|---|---|
| $(OH)_4Si_{8-y}Al_y(Mg_xAl_{4-x})O_{20}$ | montmorillonite |
| $(OH)_4Si_{8-y}Al_y(Mg_{6-z}Li_z)O_{20}$ | hectorite |
| $(OH)_4Si_{8-y}Al_y(Mg_{6-z}Al_z)O_{20}$ | saponite |

where x=0 to 4, y=0 to 2, z=0 to 6. In addition, small amounts of iron can be incorporated into the crystal lattice of the phyllosilicates according to the above formulae. In addition, the phyllosilicates can comprise hydrogen, alkali metal and alkaline earth metal ions, in particular $Na^+$ and $Ca^{2+}$ because of their ion-exchanging properties. The amount of water of hydration is in most cases in the range from 8 to 20% by weight and is dependent on the swelling state or on the type of processing. Phyllosilicates which can be used are, for example, known from U.S. Pat. No. 3,966,629, U.S. Pat. No. 4,062,647, EP 0026529 A1 and EP 0028432 A1. Preference is given to using phyllosilicates which, because of an alkali metal treatment, are largely free from calcium ions and strongly coloring iron ions.

The preferred builder substances also include amorphous sodium silicates with an $Na_2O:SiO_2$ modulus of from 1:2 to 1:3.3, preferably from 1:2 to 1:2.8 and in particular from 1:2 to 1:2.6, which have delayed dissolution and secondary detergency properties. Delayed dissolution compared with conventional amorphous sodium silicates can be brought about in a variety of ways, for example by surface treatment, compounding, compaction/compression or by overdrying. For the purposes of this invention, the term "amorphous" is also to be understood as meaning "X-ray-amorphous". This means that, in X-ray diffraction experiments, the silicates do not produce sharp X-ray reflections typical of crystalline substances, but, at best, one or more maxima of the scattered X-ray radiation having a breadth of several degree units of the diffraction angle. However, particularly good builder properties may very likely result if the silicate particles produce poorly defined or even sharp diffraction maxima in electron diffraction experiments. This is to be interpreted to the effect that the products have microcrystalline regions with a size from 10 to a few hundred nm, preference being given to values up to a maximum of 50 nm and in particular up to a maximum of 20 nm. Such so-called X-ray-amorphous silicates, which likewise have delayed dissolution compared with traditional water glasses, are described, for example, in German patent application DE 4400024 A1. Particular preference is given to compressed/compacted amorphous silicates, compounded amorphous silicates and overdried X-ray-amorphous silicates.

The use of the generally known phosphates as builder substances is of course also possible, provided such a use is not to be avoided for ecological reasons. In particular, the sodium salts of the orthophosphates, of the pyrophosphates and, in particular, of the tripolyphosphates, are suitable.

Cobuilders

Organic framework substances which can be used and are suitable as cobuilders are, for example, the polycarboxylic acids which can be used in the form of their sodium salts, such as citric acid, adipic acid, succinic acid, glutaric acid, tartaric acid, sugar acids, aminocarboxylic acids, nitrilotriacetic acid (NTA), provided such a use is not objectionable for ecological reasons, and mixtures thereof. Preferred salts are the salts of the polycarboxylic acids, such as citric acid, adipic acid, succinic acid, glutaric acid, tartaric acid, sugar acids and mixtures thereof. The acids per se can also be used. In addition to their builder action, the acids typically also have the property of an acidifying component and thus also serve for setting a relatively low and relatively mild pH of detergents or cleaners. In this connection, particular mention may be made of citric acid, succinic acid, glutaric acid, adipic acid, gluconic acid and any mixtures thereof.

Further suitable organic builder substances are dextrins, for example oligomers or polymers of carbohydrates which can be obtained by partial hydrolysis of starches. The hydrolysis can be carried out in accordance with customary, for example acid-catalyzed or enzyme-catalyzed, processes. The hydrolysis products preferably have average molar masses in the range from 400 to 500 000. Here, a polysaccharide with a dextrose equivalent (DE) in the range from 0.5 to 40, in particular from 2 to 30, is preferred, where DE is a usual measure of the reducing action of a polysaccharide compared with dextrose, which has a DE of 100. It is possible to use either maltodextrins with a DE between 3 and 20 and dry glucose syrups with a DE between 20 and 37, and also so-called yellow dextrins and white dextrins with relatively high molar masses in the range from 2000 to 30 000. A preferred dextrin is described in British patent application GB 9419091 A1. The oxidized derivatives of such dextrins are their reaction products with oxidizing agents which are able to oxidize at least one alcohol function of the saccharide ring to give the carboxylic acid function. Such oxidized dextrins and processes for their preparation are known, for example, from European patent applications EP 0232202 A1, EP 0427349 A1, EP 0472042 A1 and EP 0542496 A1, and the international patent applications WO 92/18542, WO 93/08251, WO 93/16110, WO 94/28030, WO 95/07303, WO 95/12619 and WO 95/20608. Also suitable is an oxidized oligosaccharide according to German patent application DE 19600018 A1. A product oxidized on $C_6$ of the saccharide ring may be particularly advantageous.

Further suitable cobuilders are oxydisuccinates and other derivatives of disuccinates, preferably ethylenediamine disuccinate. Particular preference is also given in this connection to glycerol disuccinates and glycerol trisuccinates, as are described, for example, in US-American patent specifications U.S. Pat. No. 4,524,009, U.S. Pat. No. 4,639,325, in the European patent application EP 0150930 A1 and the Japanese patent application JP 93/339896. Suitable use amounts in zeolite-containing and/or silicate-containing formulations are 3 to 15% by weight. Further organic cobuilders which can be used are, for example, acetylated hydroxycarboxylic acids or salts thereof, which may optionally also be in lactone form and which contain at least 4 carbon atoms and at least one hydroxyl group and a maximum of two acid groups. Such cobuilders are described, for example, in international patent application WO 95/20029.

Suitable polymeric polycarboxylates are, for example, the sodium salts of polyacrylic acid or of polymethacrylic acid, for example those with a relative molecular mass of from 800 to 150 000 (based on acid and in each case measured against polystyrenesulfonic acid). Suitable copolymeric polycarboxylates are, in particular, those of acrylic acid with methacrylic acid and of acrylic acid or methacrylic acid with maleic acid. Copolymers of acrylic acid with maleic acid which contain 50 to 90% by weight of acrylic acid and 50 to 10% by weight of maleic acid have proven particularly suitable. Their relative molecular mass, based on free acids, is generally 5 000 to 200 000, preferably 10 000 to 120 000 and in particular 50 000 to 100 000 (in each case measured against polystyrenesulfonic acid). The (co)polymeric polycarboxylates can either be used as powder or as aqueous solution, preference being given to 20 to 55% by weight strength aqueous solutions. Granular polymers are in most cases added subsequently to one or more base granules. Particular preference is also given to biodegradable polymers of more than two different monomer units, for example those which, according to DE 4300772 A1, contain salts of acrylic acid and of maleic acid and vinyl alcohol or vinyl alcohol derivatives as monomers, or, according to DE 4221381 C2, salts of acrylic acid and of 2-alkylallylsulfonic acid and sugar derivatives as monomers. Further preferred copolymers are those which are described in German patent applications DE 4303320 A1 and DE 4417734 A1 and have, as monomers, preferably acrolein and acrylic acid/acrylic acid salts or acrolein and vinyl acetate. Further preferred builder substances are also polymeric aminodicarboxylic acids, salts thereof or precursor substances thereof. Particular preference is given to polyaspartic acids or salts and derivatives thereof.

Further suitable builder substances are polyacetals, which can be obtained by reacting dialdehydes with polyolcarboxylic acids which have 5 to 7 carbon atoms and at least 3 hydroxyl groups, for example as described in European patent application EP 0280223 A1. Preferred polyacetals are obtained from dialdehydes such as glyoxal, glutaraldehyde, terephthalaldehyde and mixtures thereof and from polyolcarboxylic acids such as gluconic acid and/or glucoheptonic acid.

Oil- and Grease-Dissolving Substances

Preferred oil- and grease-dissolving components include, for example, nonionic cellulose ethers, such as methylcellulose and methylhydroxypropylcellulose having a proportion of methoxy groups of from 15 to 30% by weight and of hydroxypropoxy groups of from 1 to 15% by weight, in each case based on the nonionic cellulose ethers, and the polymers, known from the prior art, of phthalic acid and/or of terephthalic acid, or of derivatives thereof, in particular polymers of ethylene terephthalates and/or polyethylene glycol terephthalates or anionically and/or nonionically modified derivatives thereof. Of these, particular preference is given to the sulfonated derivatives of phthalic acid and of terephthalic acid polymers.

Bleaches and Bleach Activators

Among the compounds which supply $H_2O_2$ in water and which serve as bleaches, sodium perborate tetrahydrate and sodium perborate monohydrate are of particular importance. Further bleaches which can be used are, for example, sodium percarbonate, peroxypyrophosphates, citrate perhydrates, and $H_2O_2$-supplying peracidic salts or peracids, such as perbenzoates, peroxophthalates, diperazelaic acid, phthaloimino peracid or diperdodecanedioic acid. The content of bleaches in the compositions is preferably 5 to 35% by weight and in particular up to 30% by weight, where perborate monohydrate or percarbonate is used advantageously.

Bleach activators which can be used are compounds which, under perhydrolysis conditions, produce aliphatic peroxocarboxylic acids having, preferably, 1 to 10 carbon atoms, in particular 2 to 4 carbon atoms, and/or optionally substituted perbenzoic acid. Substances which carry O- and/or N-acyl groups of said number of carbon atoms and/or optionally substituted benzoyl groups are suitable. Preference is given to polyacylated alkylenediamines, in particular tetraacetylethylenediamine (TAED), acylated triazine derivatives, in particular 1,5-diacetyl-2,4-dioxohexahydro-1,3,5-triazine (DADHT), acylated glycolurils, in particular tetraacetylglycoluril (TAGU), N-acylimides, in particular N-nonanoylsuccinimide (NOSI), acylated phenolsulfonates, in particular n-nonanoyl- or iso-nonanoyloxybenzenesulfonate (n- or iso-NOBS), carboxylic anhydrides, in particular phthalic anhydride, acylated polyhydric alcohols, in particular triacetin, ethylene glycol diacetate, 2,5-diacetoxy-2,5-dihydrofuran and the enol esters known from German patent applications DE 19616693 A1 and DE 19616767 A1, and acetylated sorbitol and mannitol or mixtures thereof described in European patent application EP 0525239 A1 (SORMAN), acylated sugar derivatives, in particular pentaacetylglucose (PAG), pentaacetylfructose, tetraacetylxylose and octaacetyllactose, and acetylated, optionally N-alkylated glucamine and gluconolactone, and/or N-acylated lactams, for example N-benzoylcaprolactam, which are known from international patent applications WO 94/27970, WO 94/28102, WO 94/28103, WO 95/00626, WO 95/14759 and WO 95/17498. The hydrophilically substituted acylacetals known from German patent application DE 19616769 A1, and the acyllactams described in German patent application DE 196 16 770 and international patent application WO 95/14075 are likewise used with preference. Combinations of conventional bleach activators known from German patent application DE 4443177 A1 can also be used. Such bleach activators are present in the customary quantitative range, preferably in amounts of from 1% by weight to 10% by weight, in particular 2% by weight to 8% by weight, based on the overall composition. In addition to the above-listed conventional bleach activators, or instead of them, the sulfonimines known from European patent specifications EP 0446982 B1 and EP 0453 003 B1 and/or bleach-boosting transition metal salts or transition metal complexes may also be present as so-called bleach catalysts. Suitable transition metal compounds include, in particular, the manganese-, iron-, cobalt-, ruthenium- or molybdenum-salen complexes known from German patent application DE 19529905 A1, and their N-analogous compounds known from German patent application DE 19620267 A1, the manganese-, iron-, cobalt-, ruthenium- or molybdenum-carbonyl complexes known from German patent application DE 19536082 A1, the manganese, iron, cobalt, ruthenium, molybdenum, titanium, vanadium and copper complexes having nitrogen-containing tripod ligands described in German patent application DE 19605688 A1, the cobalt-, iron-, copper- and ruthenium-amine complexes known from German patent application DE 19620411 A1, the manganese, copper and cobalt complexes described in German patent application DE 4416438 A1, the cobalt complexes described in European patent application EP 0272030 A1, the manganese complexes known from European patent application EP 0693550 A1, the manganese, iron, cobalt and copper complexes known from European patent specification EP 0392592 A1, and/or the manganese complexes described in European patent specification EP 0443651 B1 or European patent applications EP 0458397 A1, EP 0458398 A1, EP 0549271 A1, EP 0549272 A1, EP 0544490 A1 and EP 0544519 A1. Combinations of bleach activators and transition metal bleach catalysts are known, for example, from German patent application DE 19613103 A1 and international patent application WO 95/27775. Bleach-boosting transition metal complexes, in particular containing the central atoms Mn, Fe, Co, Cu, Mo, V, Ti and/or Ru, can likewise be used.

Enzymes and Enzyme Stabilizers

Suitable enzymes are, in particular, those from the class of hydrolases, such as proteases, esterases, lipases or enzymes with lipolytic action, amylases, cellulases or other glycosyl-hydrolases and mixtures of said enzymes. All of these hydrolases contribute during washing to the removal of stains, such as protein, grease or starchy stains, and redeposition. Cellulases and other glycosyl hydrolases may, by removing pilling and microfibrils, contribute to color retention and to an increase in the softness of the textile. For bleaching or for inhibiting color transfer, it is also possible to use oxidoreductases. Particularly suitable enzymatic active ingredients are those obtained from bacterial strains or fungi, such as *Bacillus subtilis, Bacillus licheniformis, Streptomyces griseus* and *Humicola insolens*. Preference is given to using proteases of the subtilisin type and, in particular, proteases obtained from *Bacillus lentus*. Of particular interest in this connection are enzyme mixtures, for example mixtures of protease and amylase or protease and lipase or lipolytic enzymes, or protease and cellulose or of cellulase and lipase or lipolytic enzymes or of protease, amylase and lipase or lipolytic enzymes or protease, lipase or lipolytic enzymes and cellulase, in particular, however, protease- and/or lipase-containing mixtures or mixtures containing lipolytic enzymes. Examples of such lipolytic enzymes are the known cutinases. Peroxidases or oxidases have also proven suitable in some cases. Suitable amylases include, in particular, α-amylases, isoamylases, pullulanases and pectinases. The cellulases used are preferably cellobiohydrolases, endoglucanases and β-glucosidases, which are also called cellobiases, or mixtures thereof. Since the various cellulase types differ in their CMCase and avicelase activities, it is possible to adjust the desired activities through targeted mixing of the cellulases. The enzymes can be adsorbed on carrier substances and/or embedded in coating substances in order to protect them against premature decomposition.

In addition to the mono- and polyfunctional alcohols, the compositions can comprise further enzyme stabilizers. For example, 0.5 to 1% by weight of sodium formate can be used. The use of proteases which have been stabilized with soluble calcium salts and a calcium content of, preferably, about 1.2% by weight, based on the enzyme, is also possible. Apart from calcium salts, magnesium salts also serve as stabilizers. However, the use of boron compounds, for example of boric acid, boron oxide, borax and other alkali metal borates, such as the salts of orthoboric acid ($H_3BO_3$), of metaboric acid ($HBO_2$) and of pyroboric acid (tetraboric acid $H_2B_4O_7$) is particularly advantageous.

Antiredeposition Agents

Antiredeposition agents have the task of keeping the soil detached from the fiber in suspended form in the liquor, and thus preventing reattachment of the soil.

For this purpose, water-soluble colloids of a mostly organic nature are suitable, for example the water-soluble salts of polymeric carboxylic acids, glue, gelatin, salts of ether carboxylic acids or ether sulfonic acids of starch or of cellulose or salts of acidic sulfuric esters of cellulose or of starch. Water-soluble polyamides which contain acidic groups are also suitable for this purpose. In addition, it is also possible to use soluble starch preparations, and starch products other than those mentioned above, e.g. degraded starch, aldehyde starches etc. Polyvinylpyrrolidone can also be used. Preference is, however, given to using cellulose ethers, such as carboxymethylcellulose (Na salt), methylcellulose, hydroxyalkylcellulose and mixed ethers, such as methylhydroxyethylcellulose, methylhydroxypropylcellulose, methylcarboxymethylcellulose and mixtures thereof, and polyvinylpyrrolidone, for example in amounts of from 0.1 to 5% by weight, based on the compositions.

Optical Brighteners

The granules can comprise derivatives of diaminostilbenedisulfonic acid, or alkali metal salts thereof, as optical brighteners. For example, salts of 4,4'-bis-(2-anilino-4-morpholino-1,3,5-triazinyl-6-amino)stilbene-2,2'-disulfonic acid or compounds constructed in a similar way which carry a diethanolamino group, a methylamino group, an anilino group or a 2-methoxyethylamino group instead of the morpholino group are suitable. Brighteners of the substituted diphenylstyryl type may also be present, e.g. the alkali metal salts of 4,4'-bis(2-sulfostyryl)diphenyl, 4,4'-bis(4-chloro-3-sulfostyryl)diphenyl, or 4-(4-chlorostyryl)-4'-(2-sulfostyryl) diphenyl. Mixtures of the above-mentioned brighteners may also be used.

Polymers

Suitable soil-repellent polymers are those which preferably contain ethylene terephthalate and/or polyethylene glycol terephthalate groups, where the molar ratio of ethylene terephthalate to polyethylene glycol terephthalate may be in the range from 50:50 to 90:10. The molecular weight of the linking polyethylene glycol units is, in particular, in the range from 750 to 5 000, i.e. the degree of ethoxylation of the polyethylene glycol group-containing polymers may be about 15 to 100. The polymers are characterized by an average molecular weight of about 5 000 to 200 000 and can have a block structure, but preferably have a random structure. Preferred polymers are those with ethylene terephthalate/polyethylene glycol terephthalate molar ratios of from about 65:35 to about 90:10, preferably from about 70:30 to 80:20. Also preferred are those polymers which have linking polyethylene glycol units with a molecular weight of from 750 to 5 000, preferably from 1 000 to about 3 000 and a molecular weight of the polymer from about 10 000 to about 50 000. Examples of commercially available polymers are the products Milease® T (ICI) or Repelotex® SRP 3 (Rhône-Poulenc).

Defoamers

Defoamers which can be used are wax-like compounds. "Wax-like" is to be understood as meaning those compounds which have a melting point at atmospheric pressure above 25° C. (room temperature), preferably above 50° C. and in particular above 70° C. The wax-like defoamer substances are virtually insoluble in water, i.e. at 20° C. they have a solubility below 0.1% by weight in 100 g of water. In principle, all wax-like defoamer substances known from the prior art may be present. Suitable wax-like compounds are, for example, bisamides, fatty alcohols, fatty acids, carboxylic esters of mono- and polyhydric alcohols, and paraffin waxes or mixtures thereof. Alternatively, the silicone compounds known for this purpose can of course also be used.

Suitable paraffin waxes are generally a complex mixture of substances without a sharp melting point. For characterization, its melting range is usually determined by differential thermoanalysis (DTA), as described in "The Analyst" 87 (1962), 420, and/or its solidification point. This is to be understood as meaning the temperature at which the paraffin converts from the liquid state to the solid state by slow cooling. Here, paraffins which are entirely liquid at room temperature, i.e. those with a solidification point below 25° C., cannot be used according to the invention. The soft waxes, which have a melting point in the range from 35 to 50° C., preferably include the group of petrolatums and hydrogenation products thereof. They are composed of microcrystalline paraffins and up to 70% by weight of oil, have an ointment-like to plastically solid consistency and represent bitumen-free residues from petroleum refining. Particular preference is given to distillation residues (petrolatum stock) of certain paraffin-base and mixed-base crude oils which are further processed to give vaseline. Preferably, they are also bitumen-free, oil-like to solid hydrocarbons deposited from distillation residues of paraffin-base and mixed-base crude oils and cylinder oil distillates by means of solvents. They are of semisolid, viscous, tacky or plastically-solid consistency and have melting points between 50 and 70° C. These petrolatums represent the most important starting base for the preparation of microcrystalline waxes. Also suitable are the solid hydrocarbons having melting points between 63 and 79° C. deposited from high-viscosity, paraffin-containing lubricating oil distillates during deparaffinization. These petrolatums are mixtures of microcrystalline waxes and high-melting n-paraffins. It is possible to use, for example, the paraffin wax mixtures known from EP 0309931 A1 which are composed of, for example, 26% by weight to 49% by weight of microcrystalline paraffin wax with a solidification point of 62° C. to 90° C., 20% by weight to 49% by weight of hard paraffin with a solidification point of 42° C. to 56° C. and 2% by weight to 25% by weight of soft paraffin with a solidification point of from 35° C. to 40° C. Preference is given to using paraffins or paraffin mixtures which solidify in the range from 30° C. to 90° C. In this connection, it is to be taken into consideration that even paraffin wax mixtures which appear to be solid at room temperature may also comprise varying proportions of liquid paraffin. In the case of the paraffin waxes which can be used according to the invention, this liquid proportion is as low as possible and is preferably not present at all. Thus, particularly preferred paraffin wax mixtures have a liquid content at 30° C. of less than 10% by weight, in particular of from 2% by weight to 5% by weight, at 40° C. a liquid content of less than 30% by weight, preferably of from 5% by weight to 25% by weight and in particular from 5% by weight to 15% by weight, at 60° C. a liquid content of from 30% by weight to 60% by weight, in particular from 40% by weight to 55% by weight, at 80° C. a liquid content of from 80% by weight to 100% by weight and at 90° C. a liquid content of 100% by weight. The temperature at which a liquid content of 100% by weight of the paraffin wax is achieved is, in the case of particularly preferred paraffin wax mixtures, still below 85° C., in particular 75° C. to 82° C. The paraffin waxes may be petrolatum, microcrystalline waxes or hydrogenated or partially hydrogenated paraffin waxes.

Suitable bisamides as defoamers are those which are derived from saturated fatty acids having 12 to 22, preferably 14 to 18, carbon atoms, and from alkylenediamines having 2 to 7 carbon atoms. Suitable fatty acids are lauric acid, myristic acid, stearic acid, arachidic acid and behenic acid, and mixtures thereof, as are obtainable from natural fats or hydrogenated oils, such as tallow or hydrogenated palm oil. Suitable diamines are, for example, ethylenediamine, 1,3-propylenediamine, tetramethylenediamine, pentamethylenediamine, hexamethylenediamine, p-phenylenediamine and tolylenediamine. Preferred diamines are ethylenediamine and hexamethylenediamine. Particularly preferred bisamides are bismyristoylethylenediamine, bispalmitoylethylenediamine, bisstearoylethylenediamine and mixtures thereof, and the corresponding derivatives of hexamethylenediamine.

Suitable carboxylic esters as defoamers are derived from carboxylic acids having 12 to 28 carbon atoms; in particular, these are esters of behenic acid, stearic acid, hydroxystearic acid, oleic acid, palmitic acid, myristic acid and/or lauric acid. The alcohol moiety of the carboxylic ester comprises a mono- or polyhydric alcohol having from 1 to 28 carbon atoms in the hydrocarbon chain. Examples of suitable alcohols are behenyl alcohol, arachidyl alcohol, cocoyl alcohol, 12-hydroxystearyl alcohol, oleyl alcohol and lauryl alcohol, and also ethylene glycol, glycerol, polyvinyl alcohol, sucrose, erythritol, pentaerythritol, sorbitan and/or sorbitol. Preferred esters are those of ethylene glycol, glycerol and sorbitan, where the acid moiety of the ester is, in particular, chosen from behenic acid, stearic acid, oleic acid, palmitic acid or myristic acid. Suitable esters of polyhydric alcohols are, for example, xylitol monopalmitate, pentaerythritol monostearate, glycerol monostearate, ethylene glycol monostearate and sorbitan monostearate, sorbitan palmitate, sorbitan monolaurate, sorbitan dilaurate, sorbitan distearate, sorbitan dibehenate, sorbitan dioleate, and mixed tallow alkyl sorbitan monoesters and diesters. Glycerol esters which can be used are the mono-, di- or triesters of glycerol and said carboxylic acids, preference being given to the mono- or diesters. Glycerol monostearate, glycerol monooleate, glycerol monopalmitate, glycerol monobehenate and glycerol distearate are examples thereof. Examples of suitable natural esters as defoamers are beeswax, which consists primarily of the esters $CH_3(CH_2)_{24}COO(CH_2)_{27}CH_3$ and $CH_3(CH_2)_{26}COO(CH_2)_{25}CH_3$, and carnauba wax, which is a mixture of carnaubic acid alkyl esters, often in combination with small amounts of free carnaubic acid, further long-chain acids, high molecular weight alcohols and hydrocarbons.

Suitable carboxylic acids as further defoamer compound are, in particular, behenic acid, stearic acid, oleic acid, palmitic acid, myristic acid and lauric acid, and mixtures thereof as are obtainable from natural fats or optionally hydrogenated oils, such as tallow or hydrogenated palm oil. Preference is given to saturated fatty acids having 12 to 22, in particular 18 to 22, carbon atoms. In the same manner, the corresponding fatty alcohols of equal carbon chain length can be used.

In addition, dialkyl ethers may additionally be present as defoamers. The ethers may have an asymmetrical or symmetrical structure, i.e. contain two identical or different alkyl chains, preferably having 8 to 18 carbon atoms. Typical examples are di-n-octyl ether, di-isooctyl ether and di-n-stearyl ether. Dialkyl ethers which have a melting point above 25° C., in particular above 40° C. are particularly suitable.

Further suitable defoamer compounds are fatty ketones, which can be obtained in accordance with the relevant methods of preparative organic chemistry. They are prepared, for example, starting from carboxylic acid magnesium salts, which are pyrolyzed at temperatures above 300° C. with elimination of carbon dioxide and water, for example in accordance with German laid-open specification DE 2553900 A. Suitable fatty ketones are those which are prepared by pyrolysis of the magnesium salts of lauric acid, myristic acid, palmitic acid, palmitoleic acid, stearic acid, oleic acid, elaidic acid, petroselic acid, arachidic acid, gadoleic acid, behenic acid or erucic acid.

Further suitable defoamers are fatty acid polyethylene glycol esters, which are preferably obtained by homogeneous base-catalyzed addition reaction of ethylene oxide with fatty acids. In particular, the addition reaction of ethylene oxide with the fatty acids is carried out in the presence of alkanolamines as catalysts. The use of alkanolamines, specifically triethanolamine, leads to an extremely selective ethoxylation of the fatty acids, particularly when the aim is to prepare compounds which have a low degree of ethoxylation. Within the group of fatty acid polyethyleneglycol esters, preference is given to those which have a melting point above 25° C., in particular above 40° C.

Within the group of wax-like defoamers, particular preference is given to the paraffin waxes described used alone as wax-like defoamers, or in a mixture with one of the other wax-like defoamers, where the proportion of paraffin waxes in the mixture preferably constitutes more than 50% by weight, based on wax-like defoamer mixture. The paraffin waxes can be applied to supports as required. Suitable carrier materials are all known inorganic and/or organic carrier materials. Examples of typical inorganic carrier materials are alkali metal carbonates, aluminosilicates, water-soluble phyllosilicates, alkali metal silicates, alkali metal sulfates, for example sodium sulfate, and alkali metal phosphates. The alkali metal silicates are preferably a compound with an alkali metal oxide to $SiO_2$ molar ratio of from 1:1.5 to 1:3.5. The use of such silicates results in particularly good particle properties, in particular high abrasion stability and nevertheless a high dissolution rate in water. The aluminosilicates referred to as carrier material include, in particular, the zeolites, for example zeolite NaA and NaX. The compounds referred to as water-soluble phyllosilicates include, for example, amorphous or crystalline water glass. In addition, it is possible to use silicates which are available commercially under the name Aerosil® or Sipernat®. Suitable organic carrier materials are, for example, film-forming polymers, for example polyvinyl alcohols, polyvinylpyrrolidones, poly(meth)acrylates, polycarboxylates, cellulose derivatives and starch. Cellulose ethers which can be used are, in particular, alkali metal carboxymethylcellulose, methylcellulose, ethylcellulose, hydroxyethylcellulose and cellulose mixed ethers, such as, for example, methylhydroxyethylcellulose and methylhydroxypropylcellulose, and mixtures thereof. Particularly suitable mixtures are composed of sodium carboxymethylcellulose and methylcellulose, where the carboxymethylcellulose usually has a degree of substitution of from 0.5 to 0.8 carboxymethyl groups per anhydroglucose unit and the methylcellulose has a degree of substitution of from 1.2 to 2 methyl groups per anhydroglucose unit. The mixtures preferably comprise alkali metal carboxymethylcellulose and nonionic cellulose ethers in weight ratios of from 80:20 to 40:60, in particular from 75:25 to 50:50. A suitable carrier is also natural starch which is composed of amylose and amylopectin. Natural starch is the term used to describe starch such as is available as an extract from natural sources, for example from rice, potatoes, corn and wheat. Natural starch is a commercially available product and thus readily available. As carrier materials it is possible to use one or more of the compounds mentioned above, in particular chosen from the group of alkali metal carbonates, alkali metal sulfates, alkali metal phosphates, zeolites, water-soluble phyllosilicates, alkali metal silicates, polycarboxylates, cellulose ethers, polyacrylate/polymethacrylate and starch. Particularly suitable mixtures are those of alkali metal carbonates, in particular sodium carbonate, alkali metal silicates, in particular sodium silicate, alkali metal sulfates, in particular sodium sulfate and zeolites.

Suitable silicones are customary organopolysiloxanes which may have a content of finely divided silica, which in turn may also be silanized. Such organopolysiloxanes are described, for example, in European patent application EP 0496510 A1. Particular preference is given to polydiorganosiloxanes and, in particular, polydimethylsiloxanes which are known from the prior art. Suitable polydiorganosiloxanes have a virtually linear chain and have a degree of oligomerization of from 40 to 1500. Examples of suitable substituents are methyl, ethyl, propyl, isobutyl, tert-butyl and phenyl. Also suitable are amino-, fatty acid-, alcohol-, polyether-, epoxy-, fluorine-, glycoside- and/or alkyl-modified silicone compounds, which may either be liquid or in resin form at room temperature. Also suitable are simethicones, which are mixtures of dimethicones having an average chain length of from 200 to 300 dimethylsiloxane units and hydrogenated silicates. As a rule, the silicones generally, and the polydiorganosiloxanes in particular, contain finely divided silica, which may also be silanized. For the purposes of the present invention, silica-containing dimethylpolysiloxanes are particularly suitable. The polydiorganosiloxanes advantageously have a Brookfield viscosity at 25° C. (spindle 1, 10 rpm) in the range from 5 000 mPas to 30 000 mPas, in particular from 15 000 to 25 000 mPas. The silicones are preferably used in the form of their aqueous emulsions. The silicone is generally added to an initial charge of water with stirring. If desired, in order to increase the viscosity of the aqueous silicone emulsions, it is possible to add thickeners, as are known from the prior art. These may be inorganic and/or organic in nature, and particular preference is given to nonionic cellulose ethers, such as methylcellulose, ethylcellulose and mixed ethers, such as methylhydroxyethylcellulose, methylhydroxypropylcellulose, methylhydroxybutylcellulose, and anionic carboxycellulose products, such as carboxymethylcellulose sodium salt (abbreviation CMC). Particularly suitable thickeners are mixtures of CMC to nonionic cellulose ethers in the weight ratio 80:20 to 40:60, in particular 75:25 to 60:40. Usually, and particularly in the case of the addition of the described thickener mixtures, recommended use concentrations are from about 0.5 to 10% by weight, in particular from 2.0 to 6% by weight, calculated as thickener mixture and based on aqueous silicone emulsion. The content of silicones of the type described in the aqueous emulsions is advantageously in the range from 5 to 50% by weight, in particular from 20 to 40% by weight, calculated as silicones and based on aqueous silicone emulsion. According to a further advantageous embodiment, the aqueous silicone solutions receive, as thickener, starch accessible from natural sources, for example from rice, potatoes, corn and wheat. The starch is advantageously present in amounts of from 0.1 up to 50% by weight, based on silicone emulsion and, in particular, in a mixture with the already described thickener mixtures of sodium carboxymethylcellulose and a nonionic cellulose ether in the amounts already given. To prepare the aqueous silicone emulsions, the procedure expediently involves allowing the optionally present thickeners to preswell in water before adding the silicones. The silicones are expediently incorporated using effective stirring and mixing devices.

Disintegrants

The granules can further comprise disintegrants. This term is to be understood as meaning substances which are added to the shaped bodies in order to accelerate their disintegration upon contact with water. Overviews on this subject can be found, for example, in J. Pharm. Sci. 61 (1972), Römpp Chemielexikon, $9^{th}$ Edition, Volume 6, p. 4440 and Voigt "Lehrbuch der pharmazeutischen Technologie" [Textbook of Pharmaceutical Technology] ($6^{th}$ Edition, 1987, pp. 182–184). These substances increase in volume upon ingress of water, with on the one hand an increase in the intrinsic volume (swelling) and on the other hand, by way of release of gases as well, the possibility of generating a pressure which causes the tablet to disintegrate into smaller particles. Examples of established disintegration auxiliaries are carbonate/citric acid systems, with the use of other organic acids also being possible. Examples of swelling disintegration auxiliaries are synthetic polymers such as optionally crosslinked polyvinylpyrrolidone (PVP) or natural polymers and/or modified natural substances such as cellulose and starch and their derivatives, alginates or casein derivatives. Preferred disintegrants used for the purposes of the present invention are disintegrants based on cellulose. Pure cellulose has the formal gross composition $(C_6H_{10}O_5)_n$, and, considered formally, is a β-1,4-polyacetal of cellobiose, which itself is constructed from two molecules of glucose. Suitable celluloses consist of about 500 to 5 000 glucose units and, accordingly, have average molar masses of from 50 000 to 500 000. Cellulose-based disintegrants which can be used for the purposes of the present invention are also cellulose derivatives obtainable by polymer-analogous reactions from cellulose. Such chemically modified celluloses include, for example, products of esterifications and etherifications in which hydroxyl hydrogen atoms have been substituted. However, celluloses in which the hydroxyl groups have been replaced by functional groups not attached via an oxygen atom may also be used as cellulose derivatives. The group of cellulose derivatives includes, for example, alkali metal celluloses, carboxymethylcellulose (CMC), cellulose esters and ethers and also aminocelluloses. Said cellulose derivatives are preferably not used alone as cellulose-based disintegrants, but instead are used in a mixture with cellulose. The cellulose derivative content of these mixtures is preferably less than 50% by weight, particularly preferably less than 20% by weight, based on the cellulose-based disintegrant. A particularly preferred cellulose-based disintegrant used is pure cellulose which is free from cellulose derivatives. A further cellulose-based disintegrant, or constituent of this component, which may be used is microcrystalline cellulose. This microcrystalline cellulose is obtained by partial hydrolysis of celluloses under conditions which attack only the amorphous regions (approximately 30% of the total cellulose mass) of the celluloses and break them up completely, but leave the crystalline regions (about 70%) intact. Subsequent deaggregation of the microfine celluloses resulting from the hydrolysis yields the microcrystalline celluloses, which have primary particle sizes of approximately 5 μm and can be compacted, for example, to give granules having an average particle size of 200 μm. The disintegrants can, viewed macroscopically, be homogeneously distributed within the shaped body, but, viewed microscopically, form zones of increased concentration as a result of the preparation. Disintegrants which may be present for the purposes of the invention, such as, for example, kollidon, alginic acid and alkali metal salts thereof, amorphous and also partially crystalline phyllosilicates (bentonites), polyacrylates, polyethylene glycols are given, for example, in the printed specifications WO 98/40462 (Rettenmaier), WO 98/55583 and WO 98/55590 (Unilever) and WO 98/40463, DE 19709991 and DE 19710254 (Henkel). Reference is expressly made to the teaching of these specifications.

Fragrances

Perfume oils or fragrances which can be used are individual fragrance compounds, e.g. the synthetic products of the ester, ether, aldehyde, ketone, alcohol and hydrocarbon type. Fragrance compounds of the ester type are, for example, benzyl acetate, phenoxyethyl isobutyrate, p-tert-butylcyclohexyl acetate, linalyl acetate, dimethylbenzylcarbinyl acetate, phenylethyl acetate, linalyl benzoate, benzyl formate, ethyl methylphenylglycinate, allyl cyclohexylpropionate, styrallyl propionate and benzyl salicylate. The ethers include, for example, benzyl ethyl ether; the aldehydes include, for example, the linear alkanals having 8–18 carbon atoms, citral, citronellal, citronellyloxyacetaldehyde, cyclamen aldehyde, hydroxycitronellal, lillial and bourgeonal; the ketones include, for example, the ionones, α-isomethylionone and methyl cedryl ketone; the alcohols include anethole, citronellol, eugenol, geraniol, linalool, phenylethyl alcohol and terpineol; the hydrocarbons include primarily the terpenes, such as limonene and pinene. Preference is, however, given to using mixtures of different fragrances, which together produce an appealing fragrance note. Such perfume oils can also comprise natural fragrance mixtures, such as are obtainable from vegetable sources, e.g. pine oil, citrus oil, jasmine oil, patchouli oil, rose oil or ylang ylang oil. Likewise suitable are muscatel, sage oil, camomile oil, clove oil, balm oil, mint oil, cinnamon leaf oil, lime blossom oil, juniper berry oil, vetiver oil, olibanum oil, galbanum oil and labdanum oil, and orange blossom oil, neroli oil, orange peel oil and sandalwood oil. The fragrances can be incorporated directly into the granules according to the invention, although it is also advantageous to apply the fragrances to carriers which enhance the adhesion of the perfume to the laundry and, as a result of a slower release of fragrance, ensure long-lasting fragrance of the textiles. Cyclodextrins have, for example, proven successful as such carrier materials, where the cyclodextrin-perfume complexes can also additionally be coated with further auxiliaries.

Inorganic Salts

Further suitable ingredients of the granules are water-soluble inorganic salts, such as bicarbonates, carbonates, amorphous silicates, normal waterglasses, which do not have prominent builder properties, or mixtures thereof; in particular, alkali metal carbonate and/or amorphous alkali metal silicate, primarily sodium silicate with an $Na_2O:SiO_2$ molar ratio of from 1:1 to 1:4.5, preferably from 1:2 to 1:3.5, are used.

Mixing

The mixing of the depleted glycoside/fatty alcohol melts with the other detergent ingredients can be carried out continuously or batchwise in a manner known per se. Suitable for this purpose are, for example, components of the type Dreis continuous annular layer mixer K-TT, Hosokawa Turbulizer, Schugi Flexomix, Shugi Extrud-O-Mix or Eirisch mixers. Preference is, however, given to using Lödige mixers, e.g. of the type CB or FKM, or VRV dryers of the type Flash-Dryer. In the case of mixing in one of said mixers, the additive is generally initially introduced and the melt is sprayed on, whereas in the case of the Flash-Dryer, which has three zones which can be heated independently of one another, the melt is introduced and then continuously impacted with the additive by means of a solids-metering device. In this connection, the additives are generally metered in in an amount such that granules are obtained which arise 30 to 60% and preferably 45 to 55% by weight of alkyl or alkenyl oligoglycosides.

EXAMPLES

Example 1

From a technical-grade $C_{12}$–$C_{14}$-cocoalkyl oligoglucoside mixture with a residual fatty alcohol content of 68% by weight, a thin-film evaporator (exchange area 0.3 $m^2$, throughput 13.5 kg/h, temperature 137° C., operating pressure 1 mbar) was used to reduce the alcohol content to 23.5% by weight. The resulting pale yellow melt was metered together with zeolite (Wessalith® P, Degussa, addition by means of solids-metering device, 5 kg/h) continuously into a VRV dryer of the Flash Dryer type with a heat-exchange area of 0.44 $m^2$; the temperatures in the three heatable zones were 110, 60 and 20° C. Flowable granules were obtained.

Example 2

From a technical-grade $C_{12}$–$C_{14}$-cocoalkyl oligoglucoside mixture with a residual fatty alcohol content of 68% by weight, a short-path evaporator (exchange area 4.3 $dm^2$, throughput 2.2 kg/h, temperature 147° C., operating pressure 0.5 mbar) was used to reduce the alcohol content to 10.6% by weight. In a 5 l Lödige mixer with chopper, 600 g of cellulose (Technocell® 100) were introduced and premixed for 2 min at maximum speed. Then, over the course of 3 min, 257 g of the glucoside/fatty alcohol melt obtained previously were metered in using the chopper and after-mixed for 30 s. Flowable granules were obtained.

What is claimed is:

1. A process for preparing anhydrous detergent granules, said process comprising:

(a) providing an alk(en)yl oligoglycoside composition having a residual fatty alcohol content in need of reduction to less than 30% by weight;

(b) independently of step (c), partially reducing the fatty alcohol content of the alk(en)yl oligoglycoside composition to less than 30% by weight to provide a partially reduced alcohol content alk(en)yl oligoglycoside melt;

(c) combining the partially reduced alcohol content alk(en)yl oligoglycoside melt with one or more detergent additives, and (d) forming detergent granules from the resulting combined product.

2. The process according to claim 1, wherein the alk(en)yl oligoglycoside composition comprises a technical-grade mixture of two or more alk(en)yl oligoglycosides.

3. The process according to claim 1, wherein the alk(en)yl oligoglycoside composition comprises an alk(en)yl oligoglycoside of the general formula (I):

$$R^1O\text{-}[G]_p \qquad (I)$$

wherein $R^1$ represents an alk(en)yl radical having from 4 to 22 carbon atoms, G represents a sugar moiety having from 5 to 6 carbon atoms, and p represents a number of from 1 to 10.

4. The process according to claim 1, wherein the residual fatty alcohol content comprises an alcohol of the general formula (II):

$$R^2OH \quad (II)$$

wherein $R^2$ represents an aliphatic hydrocarbon radical having from 6 to 22 carbon atoms and up to three unsaturated carbon—carbon double bonds.

5. The process according to claim 3, wherein the residual fatty alcohol content comprises an alcohol of the general formula (II):

$$R^2OH \quad (II)$$

wherein $R^1$ and $R^2$ are the same.

6. The process according to claim 1, wherein the starting alk(en)yl oligoglycoside composition of step (a) comprises an alk(en)yl oligoglycoside component and a fatty alcohol component in a ratio by weight of from 50:50 to 10:90.

7. The process according to claim 5, wherein the starting alk(en)yl oligoglycoside composition of step (a) comprises an alk(en)yl oligoglycoside component and a fatty alcohol component in a ratio by weight of from 50:50 to 10:90.

8. The process according to claim 1, wherein the fatty alcohol content of the composition is partially reduced to 5–25% by weight.

9. The process according to claim 5, wherein the fatty alcohol content of the composition is partially reduced to 5–25% by weight.

10. The process according to claim 6, wherein the fatty alcohol content of the composition is partially reduced to 5–25% by weight.

11. The process according to claim 1, wherein the partial reduction of fatty alcohol content is carried out using an evaporator.

12. The process according to claim 5, wherein the partial reduction of fatty alcohol content is carried out using an evaporator.

13. The process according to claim 1, wherein the partially reduced alcohol content alk(en)yl oligoglycoside melt is combined with one or more detergent additives in an amount of from 30 to 60% by weight.

14. The process according to claim 5, wherein the partially reduced alcohol content alk(en)yl oligoglycoside melt is combined with one or more detergent additives in an amount of from 30 to 60% by weight.

15. The process according to claim 1, wherein the partially reduced alcohol content alk(en)yl oligoglycoside melt is sprayed onto the one or more detergent additives.

16. A process for preparing anhydrous detergent granules, said process comprising:

(a) providing a technical-grade mixture of two or more alk(en)yl oligoglycoside compositions having general formula (I):

$$R^1O[G]_p \quad (I)$$

wherein $R^1$ represents an alk(en)yl radical having from 4 to 22 carbon atoms, G represents a sugar moiety having from 5 to 6 carbon atoms, and p represents a number of from 1 to 6, wherein the mixture includes a residual fatty alcohol content of in need of partial reduction to less than 25% by weight, the residual fatty alcohol content comprising an alcohol of the general formula (II):

$$R^2OH \quad (II)$$

wherein $R^2$ represents an aliphatic hydrocarbon radical having from 6 to 22 carbon atoms and up to three unsaturated carbon—carbon double bonds;

(b) independently of step (c), partially reducing the fatty alcohol content of the composition to 5–25% by weight to provide a partially reduced alcohol content alk(en)yl oligoglycoside melt;

(c) combining the partially reduced alcohol content alk (en)yl oligoglycoside melt with one or more detergent additives, and (d) forming detergent granules from the resulting combined product.

17. The process according to claim 16, wherein $R^1$ of formula (I) and $R^2$ of formula (II) are the same.

18. The process according to claim 16, wherein the starting alk(en)yl oligoglycoside composition of step (a) comprises an alk(en)yl oligoglycoside component and a fatty alcohol component in a ratio by weight of from 40:60 to 20:80.

19. The process according to claim 16, wherein steps (c) and (d) are combined.

* * * * *